United States Patent [19]

Inamorato

[11] 3,959,157

[45] May 25, 1976

[54] NON-PHOSPHATE DETERGENT-SOFTENING COMPOSITIONS

[75] Inventor: Jack Thomas Inamorato, Westfield, N.J.

[73] Assignee: Colgate-Palmolive Company, New York, N.Y.

[22] Filed: June 4, 1973

[21] Appl. No.: 366,322

[52] U.S. Cl. ..... 252/8.8; 252/8.75; 252/547

[51] Int. Cl.[2] ..... C11D 1/835; D06M 13/46

[58] Field of Search ..... 252/8.8, 8.75, 8.7, 252/547; 117/139.5 CQ

[56] References Cited

UNITED STATES PATENTS

| | | | |
|---|---|---|---|
| 3,048,539 | 8/1962 | Kocay et al. | 252/8.8 |
| 3,178,366 | 4/1965 | Dubrow et al. | 252/8.8 |
| 3,296,145 | 1/1967 | Findlan et al. | 252/547 X |
| 3,317,430 | 5/1967 | Priestley et al. | 252/547 |
| 3,325,404 | 6/1967 | Cohen et al. | 252/8.75 |
| 3,360,470 | 12/1967 | Wixon | 252/547 |
| 3,364,142 | 1/1968 | Buck | 252/8.8 |
| 3,537,993 | 11/1970 | Coward et al. | 252/8.75 |
| 3,573,091 | 3/1971 | Waldman et al. | 252/8.8 X |
| 3,630,894 | 12/1971 | Lazaridis | 252/8.7 |
| 3,711,414 | 1/1973 | Hewitt | 252/547 |

*Primary Examiner*—Herbert B. Guynn
*Attorney, Agent, or Firm*—Norman Blumenkopf; Murray M. Grill; Herbert S. Sylvester

[57] ABSTRACT

A non-phosphate liquid softergent composition possessing antistatic properties comprising 10–40% of a non-ionic surfactant and/or amine oxide surfactant, and about 3–15% of a mixture of a quaternary ammonium softener and a poly-ethoxylated alkyl or dialkyl methyl ammonium halide in an aqueous solvent medium. The detergent compositions are single phase, clear, stable liquids but may be made opaque, creamy or opalescent, if desired. Also described is a method for simultaneously washing and softening laundry without imparting water repellancy to fabrics treated therewith.

6 Claims, No Drawings

NON-PHOSPHATE DETERGENT-SOFTENING COMPOSITIONS

This invention relates to a nonphosphate liquid softergent composition and to a method of simultaneously softening and washing soiled laundry, using such liquid detergent or its constituents. More particularly, the invention is of a clear, stable, single phase, liquid detergent composition possessing anti-static properties based on a non-ionic and/or amine oxide surfactant and a combination of cationic softeners comprising a quaternary ammonium compound and a polyethoxylated ammonium compound.

Public awareness of the importance of improving the environment and avoiding disruptive effects on the ecology has been increasing greatly and, as a result thereof, widespread reexaminations of waste disposal methods have been undertaken. From various studies of our lakes, rivers, streams and ground waters, it has been concluded by some that ordinary household detergents, especially those comprising phosphate builders, have had detrimental effects on such waters.

Efforts have been made to modify detergent composition formulas so as to produce excellent cleaning agents which do not contain any phosphates. This has been difficult to accomplish because of the especially effective building, peptizing, soilsuspending and cleaning actions of the polyphosphates, especially pentasodium tripolyphosphate and tetrasodium pyrophosphate and analogous polyphosphoric acid salts. At the present time, there is great activity in providing effective, safe and acceptable detergent compositions which do not contain phosphate compounds as a builder. The present invention is directed to such compositions.

In addition to providing effective phosphate free laundry detergents, it is desirable to impart softness and anti-static properties to laundered fabrics. Heretofore, it has been found necessary to apply a fabric softening composition separately and in the final rinse because of the well-known incompatibility of the quaternary ammonium softeners with conventional anionic detergents, thereby decreasing both the cleaning efficacy of the detergent and the softening efficacy of the softener.

Another problem in the use of the quaternary ammonium softener is the tendency thereof to impart a water-repellant finish to fabrics after repeated use. To waterproof towels, diapers, and the like would be a very undesirable effect.

Consequently, it is a primary object of this invention to provide a substantially phosphate-free composition for simultaneously laundering or softening fabrics comprising a compatible detergent and fabric softener.

Another object of this invention is to provide a liquid laundry softergent which is clear and transparent.

By the term softergent, is meant a composition possessing both softening and detergency properties.

Still another object of the invention is to provide a liquid softergent possessing anti-static properties.

A further object of this invention is to provide a liquid softergent that will not impart a water-repellant finish to fabrics.

Other objects will appear hereinafter as the description proceeds.

In accordance with the above objects, the liquid nonphosphate softergent composition of this invention comprises about 15–30% of a non-ionic and/or amide oxide surfactant, and about 3–15% of a mixture of a quaternary ammonium fabric softener and a polyethoxylated alkyl or dialkyl methyl ammonium halide, in an aqueous medium.

The complete compatibility of the non-ionic and/or the amine oxide surfactants with quaternary ammonium compounds renders them particularly useful in the composition of instant invention. Consequently, the surfactant utilizable in instant softergent for efficient detergency consists essentially of a non-ionic compound, an amine oxide compound and mixtures thereof.

The nonionic surface active compounds which are contemplated are commercially known and comprise the water-soluble products which are derived from the condensation of an alkylene oxide or equivalent reactant and a reactive-hydrogen hydrophobe, The hydrophobic organic compounds may be aliphatic, aromatic or heterocyclic, although the first two classes are preferred. The preferred types of hydrophobes are higher aliphatic alcohols and alkyl phenols, although others may be used such as carboxylic acids, carboxamides, mercaptans, sulphonamides, etc. The ethylene oxide condensates with higher-alkyl phenols represent a preferred class of nonionic compounds. Usually the hydrophobic moiety should contain at least about 6 carbon atoms, and preferably at least about 8 carbon atoms, and may contain as many as about 50 carbon atoms or more. The amount of alkylene oxide will vary considerably depending upon the hydrophobe, but as a general guide and rule, at least about 5 moles of alkylene oxide per mole of hydrophobe should be used. The upper limit of alkylene oxide will vary, also, but no particular criticality can be ascribed thereto. As much as 200 or more moles of alkylene oxide per mole of hydrophobe may be employed. While ethylene oxide is the preferred and predominating oxyalkylating reagent, other lower alkylene oxides such as propylene oxide, butylene oxide, and the like may also be used or substituted in part for the ethylene oxide.

Other nonionic compounds which are suitable are the polyoxyalkylene esters of the organic acids such as the higher fatty acids, the rosin acids, tall oil acids, acids from petroleum oxidation products, etc. These esters will usually contain from about 10 to about 22 carbon atoms in the acid moiety and from about 12 to about 30 moles of ethylene oxide or its equivalent.

Still other nonionic surfactants are the alkylene oxide condensates with the higher fatty acid amides. The fatty acid group will generally contain from about 8 to about 22 carbon atoms and this will be condensed with about 10 to about 50 moles of ethylene oxide as the preferred illustration. The corresponding carboxamides and sulphonamides may also be used as substantial equivalents.

Still another class of nonionic products are the oxyalkylated higher aliphatic alcohols. The fatty alcohols should contain at least 6 carbon atoms, and preferably at least about 8 carbon atoms. The most preferred alcohols are lauryl, myristyl, cetyl, stearyl and oleyl alcohols and the said alcohols should be condensed with at least about 6 moles of ethylene oxide and, preferably about 10 to 30 moles of ethylene oxide. A typical nonionic product is oleyl alcohol condensed with 15 moles of ethylene oxide. The corresponding alkyl mercaptans when condensed with ethylene oxide are also suitable in the compositions of the present invention.

The amine oxide surfactant is also commercially known and comprises a tertiary amine oxide compound characterized as follows:

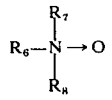

wherein $R_6$ is a higher alkyl radical having from about 16 to 22 carbon atoms, or the 2-hydroxy derivative thereof, and $R_7$ and $R_8$ are each independently methyl, ethyl, propyl, isopropyl, or hydroxyethyl radicals. The arrow designates a semi-polar bond. Amine oxides wherein $R_7$ and $R_8$ are lower alkyl groups and their method of preparation are described in Guenther U.S. Pat. No. 2,169,976. Amine oxides wherein $R_7$ and $R_8$ are hydroxyethyl and their method of preparation are described in Priestley U.S. Pat. No. 3,324,183.

Examples of suitable amine oxides operable within the invention are dimethyl hexadecyl amine oxide, dimethyl octadecyl amine oxide, bis (2-hydroxyethyl) octadecyl amine oxide, diethyl eicosyl amine oxide, dimethyl docosyl amine oxide, bis (2-hydroxyethyl) docosyl amine oxide, dipropyl-2-hydroxyoctadecyl amine oxide, diisopropyl eicosyl amine oxide, and bis (2-hydroxyethyl) tallow amine oxide.

The amount of organic detergent may vary widely depending upon the specific nature and intended use of the liquid detergent formulation. In general, however, from about 10 to about 40% by weight of the total detergent ingredients (nonionic and/or amine oxide) based on the total weight of the liquid detergent may be used, with the range of from about 15 to about 30% being preferred. The ratio of the specific surfactants may be varied within suitable performing limits.

Another essential ingredient in instant softergent is the quaternary ammonium fabric softeners which are commercially known, and may be represented by the following formulae:

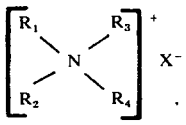

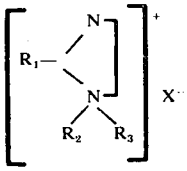

wherein $R_1$ is a long chain aliphatic radical having from 8 to 22 carbon atoms, $R_2$ is a long chain aliphatic radical having from 8 to 22 carbon atoms or is a lower alkyl radical having from 1 to 4 carbon atoms or an aryl or aralkyl radical, $R_3$ and $R_4$ are lower alkyl radicals, and X is a water soluble salt forming anion such as a halide, i.e., chloride, bromide, iodide; a sulfate, acetate, hydroxide, methosulfate or similar inorganic or organic solubilizing mono- or dibasic radical. The carbon chain of the aliphatic radical containing 8 to 22 carbon atoms may be straight or branched, and saturated or unsaturated. The lower alkyl radicals may contain a hydroxy radical. The preferred ammonium salt is a dialkyl dimethyl ammonium chloride wherein the alkyl group is derived from hydrogenated tallow or stearic acid, or a dialkyl imidazolinium chloride. Specific examples of quaternary ammonium softening agents suitable for use in the composition of the present invention include the following: hydrogenated ditallow dimethyl ammonium chloride, 1-hydroxyethyl-1 -methyl-2heptadecyl imidazolinium chloride, dimethyl distearyl ammonium chloride, trimethyl stearyl ammonium bromide, cetyl trimethyl ammonium chloride, di-coco dimethyl ammonium chloride, higher alkyl dimethyl benzyl ammonium chloride, di-isobutyl phenoxy ethoxyethyl dimethyl benzyl ammonium chloride, benzyl dimethyl stearyl ammonium chloride, the corresponding sulfate, methosulfate, bromide and hydroxide salts thereof, etc.

The term "coco" when utilized refers to fatty acid groups formed in coconut oil fatty acids. Such acids contain from about 8 to 18 carbon atoms per molecule predominating in the $C_{12-14}$ acid.

A third essential ingredient in instant softergent is the polyethoxylated alkyl or dialkyl methyl ammonium salts which may be represented by the following formula:

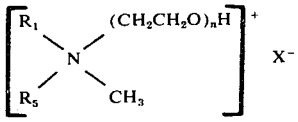

wherein $R_1$ is a long chain aliphatic radical having from 8 to 22 carbon atoms $R_5$ is an aliphatic radical having from 1 to 22 carbon atoms or $-(CH_2CH_2O)_nH$, n is a number from 10 to 60, and X is an anion as aforedefined, with the halides being preferred. It is preferred that the $R_1$ and/or $R_5$ (when $R_5$ is not oxyalkyl) groups of the polyethoxylated ammonium salts be derived from long chain fatty acids or mixtures thereof such as tallow, coconut oil, soybean oil and the like.

The effective proportions of the quaternary ammonium salt to the polyethoxylated ammonium salt can be varied from 6:1 to 1:6 respectively, with the total amount of ammonium salts constituting 3–15%, and preferably 3–8% by weight of the total composition. Although substantially equal amounts of detergent and ammonium salts may be utilized, i.e., 15% of each, it is preferred that the detergent ingredient i.e., the nonionic and/or amine oxide, constitute an excess and preferably 5 times the weight of the combined ammonium salts.

The solvent medium for instant liquid softergent is an aqueous one and may be water alone or may be substantially water. with additional solvents added for particular ingredients. Because of the availability of water and its minimum cost, it is preferred to utilize water as the major solvent present. Yet, amounts of other solvents, generally up to 20% and preferably a maximum of 15% of the total content, may be used. Generally, such a supplementing solvent will be either a lower alkanol or a lower diol or polyol, e.g., ethanol, isopropanol, ethylene glycol, propylene glycol, glycerol. Nevertheless, etheric polyols such as diethylene glycol and those known as cellosolves may also be used.

Various adjuvants may be present in the liquid detergent to give it additional desired properties, either of functional or aesthetic nature. Thus, there may be included in the formulation: soil suspending or anti-redeposition agents, e.g., polyvinyl alcohol, sodium carboxymethyl cellulose, hydroxypropyl methyl cellulose; optical brighteners, e.g., cotton, amine and polyester brighteners (which will be described in more detail subsequently); pH adjusting agents, e.g., sodium hydroxide, triethanolamine, sulfuric acid; buffering agents, e.g., sodium borate, sodium bisulfate; inorganic builder salts, e.g. borax, soda ash and silicates; bactericides, e.g., tetrachlorosalicylanilide, hexachlorophene; fungicides; dyes; pigments (water dispersible); preservatives; ultraviolet absorbers and perfumes. In the selections of the adjuvants, they will be chosen to be compatible with the main constituents of the softergent.

Of the adjuvants mentioned perhaps the most important for functional effect are the optical brighteners because the modern housewife has come to expect that washed clothing will no longer merely be clean and white but will also be bright in appearance. The optical brighteners are substantive to textiles being washed (such substantivity may be selective) and sometimes are of comparatively low solubilities. Accordingly, it is important that they be maintained in solution in the liquid detergent and even more important, they must be immediately dispersed in the wash water so as to avoid producing a wash containing noticeable brightened spots, rather than a uniformly bright appearance. Accordingly, the present composition, the components of which aid in solubilizing the brighteners, may usefully have them included in it. Here, the choice of brightener to obtain best results will be ascertainable by one of skill in the art. It has been found that relatively small quantities of brighteners should be used, so as not to exceed the limits of solubilities. Also, within the class of these materials, certain brighteners have been found to be especially readily dissolved and are most suitable for incorporation in these products. Fortunately, such preferred brighteners include both cotton and amide-polyester brighteners, making them suitable for use with laundries containing a variety of natural and synthetic materials.

Although one may use a single brightener in the compositions of the present invention, it is generally desirable to use a mixture of these so as to have good brightening effects on cotton, nylons, polyesters and blends of such materials and to maintain brightening activity even in the presence of chlorine bleaches. A good description of the various types of optical brighteners suitable for obtaining these results is given in the article, *Optical Brighteners and Their Evaluation*, by Per S. Stensby, a reprint of articles published in *Soap and Chemical Specialties* in April, May, July, August and September, 1967, especially at pages 3–5 thereof.

The cotton brighteners are frequently referred to as CC/DAS brighteners and are derived from the reaction product of cyanuric chloride and the disodium salt of diaminostilbene disulfonic acid. The compounds generally differ with respect to substituents on triazine and aromatic rings. Bleach-stable brighteners are usually benzidine sulfone disulfonic acids, a napthotriazolyl stilbene sulfonic acid or a benzimidazolyl derivative. Polyamide brighteners are generally either aminocoumarin or diphenyl parazoline derivatives and polyester brighteners, which are also useful on polyamides, may be naphthotriazolylstilbenes. The brighteners are normally present as their soluble salts but may be added as the corresponding acids. The cotton brighteners usually comprise a major part of the brightener system and are generally accompanied by a minor proportion of an amide-polyester brightener. Among the brighteners that are used in the present system are: Calcofluor White ALF (American Cyanamid); ALF-N (American Cyanamid); SOF A-2001 (CIBA); CWD (Hilton-Davis); Phorwite RKH (Verona); CSL, powder, acid (American Cyanamid); CSL, liquid, monoethanolamine salt (American Cyanamid); FB 766 (Verona); Blancophor PD (GAF); UNPA (Geigy); Tinopal RBS (Geigy); RBS 200 (Geigy); Uvitex 3257 (CIBA-Geigy) and Polar Brilliant Blue Solution.

The pH of instant liquid softergent may vary from about 6 to 8 with particularly outstanding detergency manifesting itself at a substantially neutral pH.

The aqueous solvent medium, preferably water, but which may also contain minor proportions, e.g., up to 20% thereof, of mono-, di- and polyhydric alcohol and similar solvents, will be from about 50 to 80% of the liquid softergent, preferably from 60 to 80% thereof. Often, from 10 to 60% of the water of the aqueous solvent is present with the other constituents as they are supplied, the balance being added, preferably as deionized water, during the blending process by which this detergent is produced. Although the proportion of aqueous solvent medium utilized is adjustable over fairly wide range, it will be seen that the content thereof will be limited by the solubilities of the various components. Further, since a substantial content of active ingredient is required to have desired effect, very dilute liquid softergent solutions will not be sufficiently useful.

The fluorescent brightener content of the liquid composition will normally be from 0.2 to 3% and preferably from 0.25 to 2.7. Such concentrations are soluble in the described liquid detergents and are effective in noticeably brightening the washed clothing.

The contents of other adjuvants should generally not exceed 10% and will preferably be maintained less than 5% in the phosphate-free synthetic softergent liquids. The individual components should not exceed 5 and preferably 3% of the product. Use of more than the described proportions of such compounds can often significantly change the properties of the liquid detergent and therefore, will normally be avoided.

Use of the present clear liquid softergent is both simple and exceptionally efficient. Comparatively small amounts of the liquid are employed and the product is useful in both top loading and front loading washing machines. For example, utilizing a typical formulation of the present invention, only about ⅓ cup of liquid is needed for a full automatic washing machine tub of wash, in which the water volume is from 15 to 18 gallons. Correspondingly, only 1/6 cup is used when a front loading washing machine of about half the volume of the top loading machine is employed. Thus, the concentration of liquid detergent in the wash water is only about 1 to 2.5 g./l., preferably 1.5g./l. The weights charged are about 50 grams for a horizontal tub machine and about 100 grams for a vertical tub washer.

The wash water used may be a fairly soft water or of reasonable hardness and will generally be used at elevated temperature. The present invention is also useful in laundering clothes in very hard waters and at lower temperatures. Thus, water hardnesses may range from 0 to over 300 parts per million, calculated as calcium carbonate, and washing temperatures may be from 40° to 120°F. Washing will be effected in an automatic washing machine in which the washing is followed by rinsing and spin or other draining or wringing cycles or operations. Of course, the invented liquid softergent may also be used for hand washing of laundry, in which cases it may sometimes be used full strength on certain stains on the laundry or the laundry may be soaked in a higher concentration solution of detergent before washing. The washing operations will generally take from three minutes to one hour, depending on the fabrics being washed and the degrees of soiling observed. After completion of washing and the spinning, draining or wringing operations, it is preferred to dry the laundry in an automatic dryer soon thereafter but line drying may also be employed.

The present softergent dissolves very easily in the wash water, whether that water is warm or cold, and very effectively cleans, softens and eliminates static charge on clothing and other items of laundry without imparting a water repellant finish thereto. It may be used in either top loading or front loading washing machines and may be desirably adjusted to foam to the correct extent. The product is an attractive clear, stable liquid which maintains its activity and uniformity over a long shelf life. In tests in which the effects of using it are compared to those from the employment of commercial heavy duty laundry detergents, it is rated very favorably, especially when it is considered that the composition of the invention requires no special treatment before disposal into ordinary drains or sewers. It is often preferred for convenience of use; and excellent detergency, softening, anticling and rewettability properties are observed.

This product may be prepared by simply admixing the various ingredients at room temperature with agitation to ensure solubilization thereof in the aqueous medium. The order of addition of ingredients and the temperature of compounding may be varied without adversely affecting the formation of the single phase, clear liquid product of instant invention. However, a preferred method provides for the addition of the non-ionic surfactant to the alcohol component prior to its addition to the aqueous medium, to ensure the obtention of a clear liquid with ease. It has been found that the addition of non-ionic surfactant directly to the water may cause gel formation which requires vigorous and protracted agitation to break up said gel and obtain a clear liquid.

The following examples illustrate the invention but do not limit it. All parts are by weight and the pressure is atmospheric, unless otherwise indicated.

EXAMPLE 1

| Ingredients | % |
|---|---|
| Polyethoxylated secondary alcohol of 15 carbon with an average of 9 ethylene oxide groups (non-ionic) | 20.0 |
| Dimethyl Dihydrogenated Tallow Ammonium Chloride | 2.0 |
| Dihydrogenated Tallow polyethoxylated (12–13 moles of EO) methyl ammonium chloride | 2.0 |
| Ethyl Alcohol | 8.0 |
| Triethanol Amine | 1.0 |
| Tinopal RBS-200 Brightener | 0.10 |
| Calcoflour ALF Brightener | 0.05 |
| 1% Polar Brilliant Blue Solution | 1.0 |
| Water | 65.85 |

The non-ionic is added to the ethyl alcohol at room temperature. The dihydrogenated tallow ammonium chloride, the amine, brighteners and the alcoholic solution of the non-ionic are added to the water with agitation. A stable, single phase, clear, blue slightly viscous liquid is formed.

EXAMPLE 2

| Ingredients | % |
|---|---|
| Polyethoxylated linear alcohol containing mixed 12–15 carbons condensed with an average of 7 ethylene oxide groups (non-ionic) | 15.0 |
| Polyethoxylated (15 moles) stearyl methyl ammonium chloride | 1.0 |
| Dimethyl Dihydrogenated Tallow Ammonium Chloride | 2.5 |
| Ethyl Alcohol | 10.0 |
| Triethanol Amine | 0.5 |
| CLS Brightener Solution (23% AI) | 2.0 |
| 1% Polar Brilliant Blue Solution | 0.5 |
| Perfume | 0.2 |
| Water | 68.3 |

The resultant clear, blue liquid composition is compounded as in Example 1.

EXAMPLE 3

| Ingredients | % |
|---|---|
| Polyethoxylated secondary Alchol of Example 1 | 30.0 |
| Polyethoxylated (15 moles) stearyl methyl ammonium chloride | 2.0 |
| 1-methyl-1-tallow amidoethyl-2-tallow imidazolinium methosulfate (75% Active) | 4.0 |
| Ethyl Alcohol | 10.0 |
| Triethanol Amine | 1.0 |
| Calcoflour ALF Brightener | 0.05 |
| Uvitex 3257 Brightener | 0.2 |
| Water | 52.75 |

A single phase, stable clear, transparent liquid composition is compounded in accordance with Example 1.

EXAMPLE 4

| Ingredients | % |
|---|---|
| Polyethoxylated secondary alcohol of Example 1 | 7.5 |
| Bis(2-hydroxyethyl) tallow amine oxide | 7.5 |
| Polyethoxylated (15 moles) stearyl methyl ammonium chloride | 1.0 |
| Dimethyl Dihydrogenated Tallow Ammonium Chloride | 2.5 |
| Ethyl Alcohol | 7.5 |
| Triethanol Amine | 1.0 |
| 1% Polar Brilliant Blue Solution | 0.5 |
| Perfume | 0.2 |
| Water | 72.3 |

All the ingredients are added to the water at room temperature with vigorous agitation. A clear, blue, single phase liquid composition results.

EXAMPLE 5

Propylene glycol replaces the ethyl alcohol in Example 4, yielding a clear single-phase liquid composition.

Each of the above liquid detergent compositions enabled the consumer to add a single product to her wash and obtain a good cleaning, fabric softening and non-cling fabrics without imparting a water repellant finish thereto. This is particularly desirable in the laundering of diapers, towels, tee-shirts and the like, wherein the absorption of moisture is a necessary attribute of said garments even after numerous launderings.

EXAMPLE 6

| Ingredients | % |
|---|---|
| Polyethoxylated secondary alcohol of Example 1 (non-ionic) | 7.5 |
| Bis (2-hydroxyethyl) tallow amine oxide | 15.0 |
| Triethanol Amine | 1.0 |
| 1-methyl-1-tallow amidoethyl-2-tallow imidazolinium methosulfate of Example 3 | 3.33 |
| Polyethoxylated (15 moles) stearyl methyl ammonium chloride | 1.00 |
| Ethyl alcohol | 7.5 |
| Hostalux SN Brightener | 0.15 |
| RBS 200 | 0.10 |
| Perfume | 0.2 |
| 1% Polar Brilliant Blue Solution | 0.5 |
| Water | 63.72 |

In a detergency test on soiled cotton clothes, a comparison with commercial liquid detergents utilizing tap water of 50 ppm hardness at 120°F in a laboratory Terg-o-tometer washing machine, above formulation yielded superior "Rd" readings on a reflectometer, 39.0 as against 35.8 for the commercial product (the higher value signifies greater detergency). Fabrics laundered with the product exhibited superior softness and the complete elimination of static-cling.

EXAMPLE 7

The ingredients of Example 6 are utilized except that the non-ionic surfactant is increased to 15%, the amine oxide is omitted, and the water content is adjusted accordingly.

In the detergency test described in Example 6, the Rd reading was 36.7 which is also superior to that of the commercial product. Similarly, the softness and anti-cling properties of fabrics laundered with instant composition is far superior to fabrics laundered with commercial detergents.

When utilizing a modified bundle test, which consists of a mixture of soiled colored cotton and easy care garments washed at 90°F, instant product was preferred over detergents containing 33% polyphosphates in the visual, softness and antistatic ratings.

As is apparent from the foregoing examples, the composition and process of the present invention provides a laundry detergent composition which is tri-functional. Instant products concomittantly clean, soften and eliminate static cling of garments laundered therewith. Furthermore, said garments retain their rewet properties (capability of absorbing moisture) even after numerous launderings. In addition to its use in the machine washing of fabrics, instant products have been found to be excellent for hand washing of colored and synthetic garments. Other advantages of instant product include the reduction of wrinkling of easy care (wash and wear) garments; ironing is made easier; and this product can be used together with bleach.

While various preferred embodiments of the present invention have been illustrated by means of specific examples, it is to be understood that the present invention is in no way to be deemed as limited thereto, but should be construed as broadly as all or any equivalents thereof.

What is claimed:

1. A clear, stable liquid detergent composition free of phosphate and possessing detergent anti-static and softening properties consisting essentially of (a) about 10–40% by weight of a synthetic organic detergent selected from the group consisting of (1) a $C_{16}$–$C_{22}$ alkyl-di $C_1$–$C_3$ alkyl amine oxide and (2) water soluble non-ionic surface-active compounds derived from the condensation of a $C_8$–$C_{50}$ hydrophobic compound with from 5 to 200 moles of ethylene oxide and (3) mixtures of (1) and (2); and about (b) 3-15% by weight of a mixture of (1) a quaternary ammonium fabric softener selected from the group consisting of di-long chain and di- short chain quaternary ammonium compounds and mono or di- long chain alkyl imidazolinium compounds of the formulae:

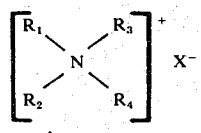

and

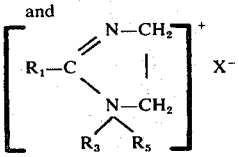

wherein $R_1$ and $R_2$ are $C_8$-$C_{22}$ alkyl radicals; $R_3$ and $R_4$ are $C_1$–$C_4$ alkyl; $R_5$ is $C_1$–$C_4$ alkyl or hydroxyalkyl, or $C_8$–$C_{22}$ alkyl radical, and X is a water-soluble salt forming anion; and (2); a polyethoxylated quaternary ammonium compound containing from 10 to 60 moles of ethylene oxide of the formula:

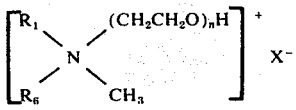

wherein $R_1$ is $C_8$ to $C_{22}$ radical, $R_6$ is $C_8$ to $C_{22}$ radical, or $-(CH_2CH_2O)_nH$, X is an anion as above defined and $n$ is a number from 10 to 60 in an aqueous solvent medium, the ratio of (a) to (b) ranging from 1:1 to 5:1 and the ratio of (b)1 to (b)2 ranging from 6:1 to 1:6.

2. A liquid composition in accordance with claim 1, wherein the organic detergent constitutes a mixture of amine oxide and non-ionic surfactants.

3. A liquid composition in accordance with claim 1, wherein the organic detergent constitutes a non-ionic surfactant.

4. A liquid composition in accordance with claim 1, wherein the solvent medium contains a maximum of 20% of a lower alkanol.

5. A liquid composition in accordance with claim 4, wherein said organic solvent is ethanol.

6. A liquid composition in accordance with claim 4, wherein the aqueous solvent constitutes about 50–80% by weight of the total composition.

* * * * *